United States Patent [19]

Shintaku

[11] Patent Number: 4,492,827

[45] Date of Patent: Jan. 8, 1985

[54] HORN SPEAKER WITH REDUCED MAGNETIC FLUX LEAKAGE

[75] Inventor: Yoshishige Shintaku, Takarazuka, Japan

[73] Assignee: Ibuki Kogyo Co., Ltd., Osaka, Japan

[21] Appl. No.: 508,248

[22] Filed: Jun. 27, 1983

[30] Foreign Application Priority Data

Jan. 31, 1983 [JP] Japan ..... 58-12679

[51] Int. Cl.[3] ..... H01F 7/00

[52] U.S. Cl. ..... 179/115.5 SF; 179/119 R

[58] Field of Search ..... 179/115.5 SF, 115.5 H, 179/120, 119 R, 117, 115.5 R; 335/231, 301

[56] References Cited

U.S. PATENT DOCUMENTS 2,895,092 7/1959 Cluwen ..... 179/115.5 SF
4,465,906 8/1984 Adolph ..... 179/115.5 SF

FOREIGN PATENT DOCUMENTS 213983 4/1959 Austria ..... 179/115.5 SF
55-11829 11/1980 Japan ..... 179/115.5 SF

OTHER PUBLICATIONS

G. Hecht, "Low Stray-Field Speaker . . . " *Funkschau*, vol. 50, No. 6, Mar. 10, 1978.

*Primary Examiner*—Gene Z. Rubinson
*Assistant Examiner*—L. C. Schroeder
*Attorney, Agent, or Firm*—Zarley, McKee, Thomte, Voorhees & Sease

[57] ABSTRACT

By adding a secondary magnetic piece with a partially open magnetic circuit to the front surface of a yoke connected to a primary magnetic piece, the magnetic flux leakage from the main magnetic piece is reduced on one hand and the magnetic flux extending across a magnetic gap is intensified through formation of a favorable magnetic field. This horn speaker is particularly useful in a ship where a horn speaker as an alarm is often required to be placed near magnetically sensitive equipment such as a compass.

2 Claims, 2 Drawing Figures

HORN SPEAKER WITH REDUCED MAGNETIC FLUX LEAKAGE

TECHNICAL FIELD

This invention relates to a horn speaker and in particular to a horn speaker which emits very little magnetic flux leakage so that it may be safely used in environment where sensitive equipment susceptible to magnetic field is present.

BRIEF DESCRIPTION OF THE DRAWINGS

The invention and prior art are described with reference to the appended drawings, in which.

BACKGROUND ART

A loudspeaker generally makes use of a powerful magnet and it is highly essential for a loudspeaker to be power efficient and high in output through the use of a powerful magnet. On the other hand, the leakage of magnetic flux from a loudspeaker is highly undesirable since a loudspeaker is often placed in environment where magnetically sensitive equipment is present. This is particularly the case in a ship, where loudspeakers, often in the form of horn speakers, are widely used as a means of alarm and at least one horn speaker is desired to be located near the helmsman who also needs a compass near him.

Magnetic flux leakage is also a problem in a color television set where magnetic flux leakage causes disruption of color tone adjustment. There is known a loudspeaker for a color television set which emits relatively little magnetic flux by providing a secondary magnetic piece for the purpose of cancelling the magnetic flux leakage from the main magnetic piece.

Figure 1:
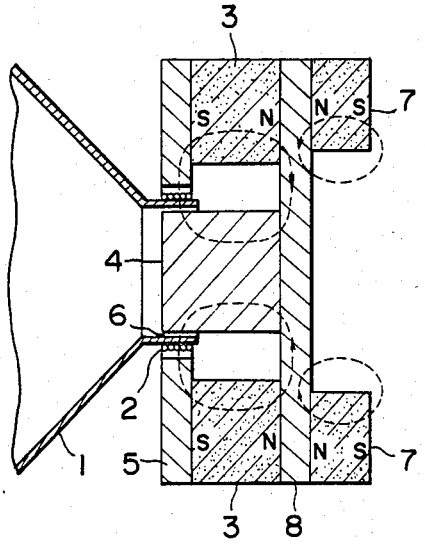
FIG. 1 is a sectional view of a loudspeaker with a conventional device for cancelling the magnetic flux generated from a main magnetic piece.

Such a known loudspeaker is illustrated in FIG. 1. Specifically, numeral 1 denotes a cone while numeral 2 denotes a voice coil wound around a tubular portion of the proximal end of the cone 1. A primary magnetic piece 3 is made of highly magnetic material and is shaped as an annulus. An annular primary yoke 5 is attached concentrically on the front surface of the primary magnetic piece 3 while a discoidal secondary yoke 8 is attached to the rear surface of the primary magnetic piece 4. Additionally a central pole piece 4 projects from the front surface of the discoidal secondary yoke 8 into the inner hole of the annular primary yoke 3 defining a gap 6 between the inner periphery of the primary yoke 5 and the front end of the central pole piece 4. The tubular portion of the cone 1 carrying the voice coil 2 is freely placed in this gap 6. So far, the structure is quite identical to a normal loudspeaker.

For the purpose of reducing magnetic flux leakage, according to this known structure, a secondary magnetic piece 7 of an annular shape is concentrically and securely fixed to the rear surface of the discoidal secondary yoke 8 so that the ends of the same polarity, N pole in the illustrated example, of the two magnetic pieces oppose one another. Here, S and N in the drawings denote the magnetic polarity and the broken lines indicate the magnetic flux.

By doing so, since the secondary magnetic piece 7 is smaller than the main magnetic piece 3 but has greater magnetic flux leakage with its rear magnetic circuit opened up and is oriented to have opposite polarity with respect to the main magnetic piece 3, the direction of this magnetic flux is opposite to that of the main magnetic piece 3 and the influence of the magnetic flux leakage of the main magnetic piece 3 is reversed with the result that the influence of the magnetic flux leakage is cancelled and the adverse influence to the color television set is eliminated.

However, according to this loudspeaker, the provision of the secondary magnetic piece contributes only to the reduction of magnetic flux leakage and does not contribute to the performance of the loudspeaker, i.e. does not increase the magnetic flux extending across the gap 6.

DISCLOSURE OF THE INVENTION

In view of such a limitation of the conventional loudspeaker with reduced magnetic flux leakage, a primary object of this invention is to provide a horn speaker with reduced magnetic flux leakage which is also improved in performance.

This object is significant in particular to the application in a ship where a horn speaker, often intended as an alarm, is preferred to be high in output and is often placed near magnetically sensitive equipment such as a compass.

According to the present invention, such an object is accomplished by providing a horn speaker with reduced magnetic flux leakage, comprising a diaphragm having a voice coil wound around a tubular portion formed on the proximal end thereof, a primary magnetic piece of an annular shape, a primary yoke of an annular shape securely fixed on the front surface of the primary magnetic piece concentrically thereto, a secondary yoke of a discoidal shape securely fixed on the rear surface of the primary magnetic piece concentrically thereto and a central pole piece extending from the front surface of the secondary yoke, defining a gap between the inner periphery of the primary yoke and the periphery of the free end of the pole piece, further comprising a secondary magnetic piece securely fixed on the front surface of the primary yoke concentrically thereto, the primary and the secondary magnetic pieces opposing one another with the ends of a same polarity, whereby magnetic flux leakage from the primary magnetic piece is reduced and the magnetic flux extending through the gap is mutually intensified by the primary and the secondary magnetic pieces.

BEST MODE OF CARRYING OUT THE INVENTION

Now the present invention is described in the following by way of example with reference to FIG. 2 which shows a horn speaker in accordance with the present invention.

Figure 2:
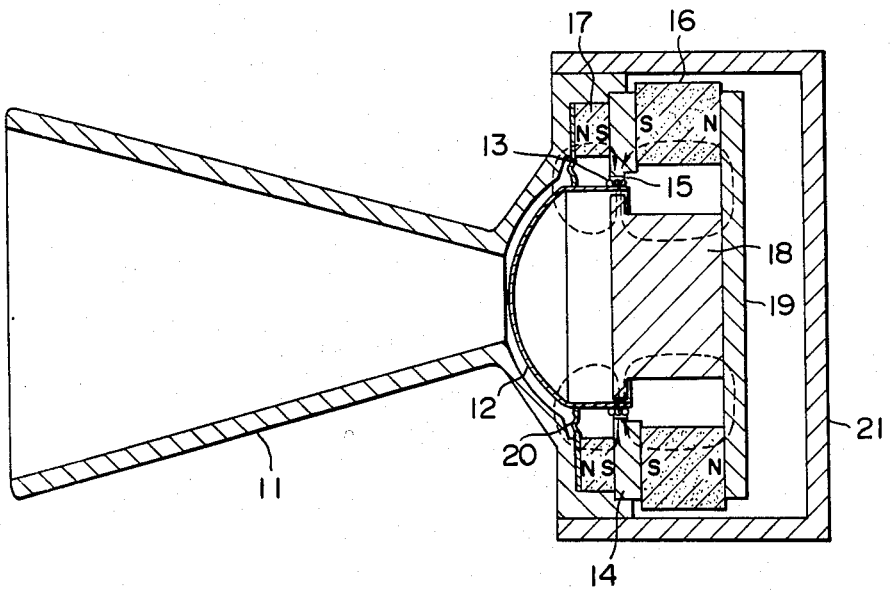
FIG. 2 is a sectional view of a horn speaker according to this invention provided with a device for both cancelling the magnetic flux leakage from a main magnetic piece and intensifying the magnetic flux extending across a magnetic gap.

In FIG. 2, numeral 11 denotes a horn while numeral 12 denotes a diaphragm having a spheroidal shape and is supported by a damper 20 to a casing 21 which is integrally assembled with the horn 11.

The proximal end or the rear end of the disphragm 12 is provided with a tubular portion serving as a bobbin for a voice coil 13.

Numeral 16 denotes a primary magnetic piece. A annular primary yoke 14 is concentrically and securely fixed to the front surface of the primary magnetic piece 16 while a discoidal secondary yoke 19 is also concentrically and securely fixed to the rear surface of the primary magnetic piece 16. A columnar central pole piece 18 projects from the central portion of the front surface of the secondary yoke 18 into the hole of the primary yoke 14, defining a gap 15 between the inner periphery of the primary yoke 14 and the front end of the central pole piece 18.

The voice coil 13 would around the tubular portion of the diaphragm 12 is freely inserted into this gap 15 so that the conduction of voice current through the voice coil 13 produces the force necessary to drive the diaphragm 12 with the voice coil 13 placed in a strong magnetic filed extending across the gap 16.

Additionally, a secondary magnetic piece 17 is concentrically and securely fixed to the front surface of the primary yoke 17 so that the ends of the same polarity, S pole in the illustrated example, of the primary and the secondary magnetic pieces oppose one another.

The magnetic circuit formed by the secondary magnetic piece 17 is not closed on the front side and the magnetic field created in front of the secondary magnetic piece 17 by the secondary magnetic piece 17 is opposite in polarity relative to that generated in the same area by the primary magnetic piece 16. Therefore, the magnetic flux leakage caused by the primary magnetic piece 16 is cancelled by the magnetic flux created by the secondary magnetic piece 17. And, by appropriately selecting the manetic properties of the secondary magnetic piece 16, it is possible to minimize the magnetic flux leakage from the horn speaker.

Furthermore, in this horn speaker, the magnetic flux of the same polarity from both the main and the secondary magnetic pieces 16 and 17 is extended through the main yoke 16 on which both the magnetic pieces are opposing one another, and magnetic flux of increased intensity is thus extended through the voice coil 13 by way of the gap 15.

According to an experiment conducted by the inventor, when a secondary magnetic piece 17 of half the thickness of the main magnetic piece 16 was used, the magnetic flux density extending through the gap 15 was increased approximately by 15 to 20% over the case in which the secondary magnetic piece 17 was not provided, although the magnetic circuit of the front side of the secondary magnetic piece 17 was open.

In other words, the efficiency of electro-acoustical conversion is accordingly increased and, with the same intensity of voice current conducted through the voice coil 13, the magnitude of the sound coming out from the horn 11 of the horn speaker of this invention was increased over a conventional horn speaker.

As described above, since the horn speaker of this invention can prevent the adverse influence on the surrounding equipment due to the magnetic flux leakage and increase the sound output at the same time through the use of the secondary magnetic piece 17, this horn speaker is highly effective as an alarm for a ship which is to be used near a compass and is desired to be powerful in output and can contribute to the reduction of the size of the overall equipment.

Although the present invention was described in terms of a specific embodiment, it is obvious to a person skilled in the art that various modifications and alterations in the actual utilization of the invention are possible without departing from the spirit of this invention which is described in the appended claims.

What is claimed is:

1. A horn speaker with reduced magnetic flux leakage, comprising:

a diaphragm having a voice coil wound around a tubular portion formed on the proximal end thereof;

a primary magnetic piece of an annular shape;

a primary yoke of an annular shape securely fixed on the front surface of the primary magnetic piece concentrically thereto;

a secondary yoke of a discoidal shape securely fixed on the rear surface of the primary magnetic piece concentrically thereto; and a central pole piece extending from the front surface of the secondary yoke, defining a gap between the inner periphery of the primary yoke and the periphery of the free end of the pole piece;

further comprising:

a secondary magnetic piece securely fixed on the front surface of the primary yoke concentrically thereto;

the primary and the secondary magnetic pieces opposing one another with the ends of a same polarity;

whereby magnetic flux leakage from the primary magnetic piece is reduced and the magnetic flux extending through the gap is mutually intensified by the primary and the secondary magnetic pieces.

2. A horn speaker according to claim 1, wherein the primary and the secondary magnetic pieces are substantially of the same material both physically and magnetically and the secondary magnetic piece is approximately half as thick as the primary magnetic piece.

* * * * *